US012460495B2

(12) United States Patent
Gil Lozano et al.

(10) Patent No.: US 12,460,495 B2
(45) Date of Patent: Nov. 4, 2025

(54) SYSTEMS AND METHODS FOR SINGLE TRIP GRAVEL PACKING IN OPEN HOLE BOREHOLE

(71) Applicant: Schlumberger Technology Corporation, Sugar Land, TX (US)

(72) Inventors: Joel Antonio Gil Lozano, Houston, TX (US); Mark Wei Xiong Yun, Seria (BN); Venkata Siva Reddy Battula, Houston, TX (US); Nabil Batita, Houston, TX (US); Joshua Jones, Fulshear, TX (US); Mark Anderson, Pearland, TX (US); Ashish Sharma, Friendswood, TX (US); Vincent Chatelet, Clamart (FR); Stephen Lewis, Aberdeen (GB); Matheus Pasti, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/730,470

(22) PCT Filed: Apr. 11, 2023

(86) PCT No.: PCT/US2023/018113
§ 371 (c)(1),
(2) Date: Jul. 19, 2024

(87) PCT Pub. No.: WO2023/200751
PCT Pub. Date: Oct. 19, 2023

(65) Prior Publication Data

US 2025/0137338 A1 May 1, 2025

Related U.S. Application Data

(60) Provisional application No. 63/362,813, filed on Apr. 11, 2022, provisional application No. 63/362,812, filed on Apr. 11, 2022.

(51) Int. Cl.
*E21B 23/06* (2006.01)
*E21B 43/04* (2006.01)
*E21B 43/08* (2006.01)

(52) U.S. Cl.
CPC ..... *E21B 23/06* (2013.01); *E21B 43/04* (2013.01); *E21B 43/082* (2013.01)

(58) Field of Classification Search
CPC .... E21B 34/045; E21B 43/084; E21B 43/086; E21B 43/088
See application file for complete search history.

(56) References Cited

U.S. PATENT DOCUMENTS 4,858,691 A * 8/1989 Ilfrey ..... E21B 43/088 166/278
7,114,697 B2 10/2006 Millet
(Continued)

FOREIGN PATENT DOCUMENTS

WO 2021207304 A1 10/2021
WO 2022055952 A1 3/2022
WO 2022256170 A1 12/2022

*Primary Examiner* — Cathleen R Hutchins
(74) *Attorney, Agent, or Firm* — Jeffrey D. Frantz

(57) ABSTRACT

A technique facilitates deployment of open hole gravel packing equipment and sand control equipment downhole in a single trip. According to an embodiment, the technique utilizes a pipe string, e.g. a workstring or a drill string, for use in an open hole gravel packing operation. The pipe string is equipped with a sand control system having at least one filtration medium, Additionally, the pipe string comprises a valve and a valve actuation device. The valve actuation device is capable of being remotely activated in a manner allowing setting of one or more packers downhole without blocking subsequent flow through the pipe string.

15 Claims, 3 Drawing Sheets

(56) References Cited

U.S. PATENT DOCUMENTS

| | | | | |
|---|---|---|---|---|
| 2003/0221829 | A1* | 12/2003 | Patel | E21B 43/10 166/278 |
| 2006/0076133 | A1* | 4/2006 | Penno | E21B 33/14 166/278 |
| 2012/0090687 | A1 | 4/2012 | Grigsby | |
| 2017/0138158 | A1 | 5/2017 | Bourgneuf | |
| 2019/0292885 | A1 | 9/2019 | Penno | |

* cited by examiner

SYSTEMS AND METHODS FOR SINGLE TRIP GRAVEL PACKING IN OPEN HOLE BOREHOLE

CROSS-REFERENCE TO RELATED APPLICATION

The present document is a national stage entry under 35 U.S.C. § 371 of International Application No.: PCT/US2023/018113, filed Apr. 11, 2023, which is based on and claims priority to U.S. Provisional Application Ser. No. 63/362,812, filed Apr. 11, 2022, and to U.S. Provisional Application Ser. No. 63/362,813, filed Apr. 11, 2022, which are incorporated herein by reference in their entirety.

BACKGROUND

Hydrocarbon fluids such as oil and natural gas are obtained from a subterranean geologic formation, referred to as a reservoir, by drilling a wellbore that penetrates the hydrocarbon-bearing formation. Such a wellbore may be lined with a string of casings and cemented in place, hence called "cased hole". Alternatively, the wellbore may stay uncased and uncemented, hence called "open hole".

Under certain circumstances it may be desirable to perform an open hole gravel packing (OHGP) operation to control sand production from the wellbore, especially if the formation is unconsolidated. Historically, the OHGP has been performed using swellable packers or mechanically activated hydrostatic set open hole packers. However, currently available technology does not provide the simplicity of integrating the OHGP assembly with a sand control assembly and deploying those assemblies in a single trip while retaining the ability of using hydraulic actuation pressure applied to an open hole packer. This is largely due to gravel pack service anti-swab tools which require a setting ball as the only mechanism for setting the production gravel pack packer, thus obstructing further pumping through the tools after the production gravel pack packer has been set. As a result, if open holes are completed using hydraulic set packers the sand control assembly and the OHGP are run in two trips.

SUMMARY

In general, a system and methodology are provided for facilitating deployment of OHGP equipment and sand control equipment downhole in a single trip. According to an embodiment, the technique utilizes a pipe string, e.g. a workstring or a drill string, for use in an open hole gravel packing operation. The pipe string is equipped with a sand control system having at least one filtration medium. Additionally, the pipe string comprises a valve and a valve actuation device. The valve actuation device is capable of being remotely activated in a manner allowing setting of one or more packers downhole without blocking subsequent flow through the pipe string.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
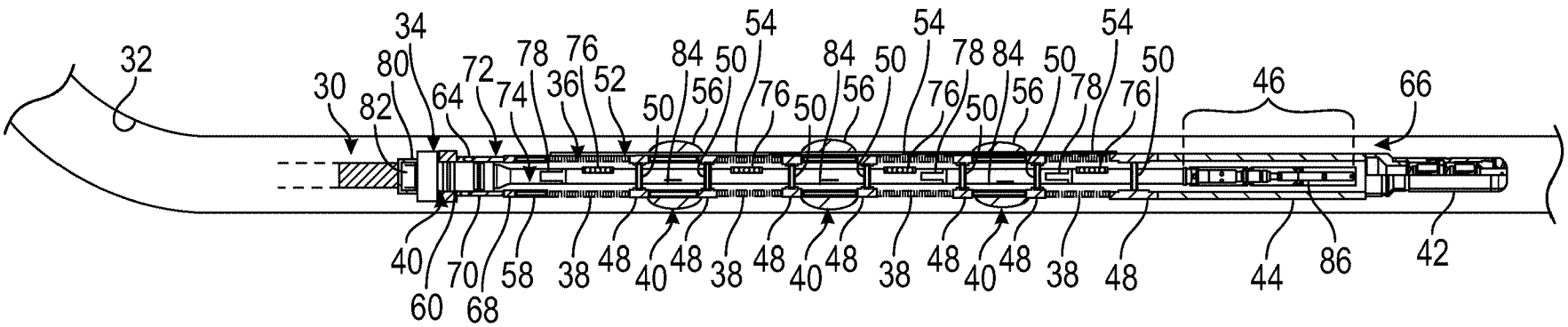
FIG. 1 is an illustration of an example of a well having a borehole containing well equipment which has been deployed downhole in a single trip, according to an embodiment of the disclosure.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood those of ordinary skill in the art that the system and/or methodology may be practiced without these details and that numerous variations or modifications from the described embodiments may be possible. This description is not to be taken in a limiting sense, but rather for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

The disclosure herein generally involves a system and methodology for facilitating deployment of OHGP equipment along with sand control equipment downhole in a single trip. According to an embodiment, the technique utilizes a pipe string for use in an open hole gravel packing operation and subsequent sand control. By way of example, the pipe string may be in the form of a workstring or a drill string.

According to an embodiment, the pipe string may be equipped with a sand control system having at least one filtration medium. Additionally, the pipe string comprises a valve and a valve actuation device which may be selectively controlled to facilitate a gravel packing operation. The valve actuation device is capable of being remotely activated in a manner allowing setting of one or more packers downhole without blocking subsequent flow through the pipe string.

In general, the system described herein is directed to a multizone single trip OHGP system which may be conveyed to a desired depth downhole on the pipe string. The system is constructed to allow inclusion of a sand control system which may include an array of individual sand control components. The pipe string is configured to thus form a unique gravel pack assembly for open hole use in combination with an open hole sand control multizone completion. The combination may be deployed in a single trip. This arrangement may be constructed to enable mechanical compartmentalization using an open hole alternate path system combined with open hole packers so as to provide gravel packing capability across an open hole section via alternate conduits when all the packers are set. Furthermore, the system is capable of performing annular flow which enters through a gravel pack tool and returns up the pipe string to the surface.

The methodology and supporting system render open hole operations more efficient by enabling use of a single trip downhole instead of the traditional two trips downhole will still enabling use of hydraulically set packers. According to one implementation, an open hole packer (or packers) for zonal isolation may be equipped with alternate path tubes. The open hole packers may be combined with a service tool using, for example, a special sleeve in combination with a rupture device, to enable pressure insensitive operation during running-in-hole, fluid circulation, and fluid returns. The service tool may be activated with pressure which, in turn, enables operation of, for example, a setting piston and sleeve so as to set the desired packer or packers.

In some embodiments, the valve and valve actuation device may be in the form of a mud pulse modem and/or flow sensing device placed at a selected location, e.g. at a bottom end of a wash pipe employed in the downhole equipment. Generally, the mud pulse modem/flow sensing device is placed within the gravel pack assembly to enable fluid circulation with respect to washdown and also with respect to returns through a mud pulse modem valve when in a gravel pack stage. However, the valve also may be actuated selectively so as to enable build up of pressure for setting a production/top gravel pack packer as well as open hole hydraulic set packers. By way of example, suitable mud pulse modem systems may be activated by interpreting changes in downhole circulation pressure so as to actuate the valve at a specific time during the gravel pack job.

Depending on the capability of the mud pulse system, various firmware and software may be used to read and recognize pressure events so as to maintain stable circulation, e.g. a desired barrels per minute of circulation, or to enable other actions. Various pressure sequences, e.g. pressure plateaus, pressure increases, and pressure bleed off, may be implemented with appropriate time periods and recognized by sensors in the mud pulse system. The pressure sequences may vary depending on the design of a specific job and they can include unique commands for a specific type of execution, e.g. valve actuation.

The firmware may be used to give the specific instruction for an action to be carried out with respect to generating an automatic valve sequence. For example, a specific pressure sequence may be used to cause valve closure so that pressure may be built up within the pipe string for setting a packer or packers at a specific pressure. The pressure sequence also may be used to open the valve to test a packer or packers. Subsequent pressure sequences may be used to set different packers at higher pressure levels or to perform other downhole actions. Once completed, the valve may be opened to enable flow through the pipe string, e.g. circulation flows through the pipe string. For example, upon completing a packer setting procedure, the mud pulse modem system may be deactivated during a subsequent gravel packing operation.

It should be noted that mechanisms other than the mud pulse system may be utilized to enable control over flow with respect to the pipe string. Such mechanisms enable control over flow along the pipe string so as to selectively enable valve closure and subsequent pressure buildup for setting packers or operating other equipment. These mechanisms further enable subsequent valve opening to facilitate gravel packing operations around the downhole sand control assembly. Accordingly, the gravel packing equipment and sand control equipment may be deployed downhole in a single trip while still retaining the ability to use hydraulically actuated packers and/or other downhole tools.

Referring generally to FIG. 1, a non-limiting example of the current system and methodology is illustrated. In this embodiment, a pipe string 30, e.g. a well string or drill string, is deployed downhole in a borehole 32. By way of example, the borehole 32 may be a wellbore for use in an oil and/or gas production well. In this embodiment, the pipe string 30 comprises an open hole gravel pack (OHGP) system 34 and a sand control system 36, e.g. a sand screen assembly, having a plurality of sand screens 38. The pipe string 30 also comprises at least one hydraulic pressure actuated open hole packer 40. In some embodiments, the pipe string 30 may comprise different types of hydraulically actuated open hole packers 40.

It should be noted the specific components of pipe string 30 may vary depending on the parameters of a given well completion job and/or environment in which borehole 32 is drilled. In this specific example, the pipe string 30 comprises a washdown shoe 42 which facilitates fluid circulation for displacement and washout. The pipe string 30 further comprises a tubing spacer 44 which may be sized to house a valve actuator tool 46 having an internal seal assembly. By way of example, the tubing spacer 44 may be approximately 30 feet in length and the valve actuator tool 46 may be of a type described below or as described in U.S. Pat. No. 7,114,697. However, the length of the tubing spacer 44 and the type of valve actuator tool 46 may vary according to the parameters of a given downhole operation.

In some embodiments, the pipe string 30 may further comprise a polished bore receptacle 48 which contains flow and pressure within a fixed volume and direction. When the polished bore receptacle 48 is used in conjunction with a functional internal seal assembly 50, it facilitates reservoir segmentation and hydrocarbon management. In the example illustrated, the desired reservoir segmentation is achieved by using several polished bore receptacles 48 with several corresponding seal assemblies 50.

The sand control system 36 may be constructed with various numbers of segments isolated between, for example, packers 40. Additionally, the sand control system 36 may utilize various filtration media for filtering out particulates during production of hydrocarbon fluids, e.g. oil and/or gas. In the embodiment illustrated, the filtration media of sand control system 36 comprises the plurality of sand screens 38 in which at least one sand screen 38 is located between selected packers 40. The sand screens 38 or other type of filtration media may comprise wire wrap, premium mesh, polymer materials, or a variety of other materials able to filter out sand/particulates. The filtration media may be used with or without shunt tubes to effectively hold in place the unwanted particulates such as gravel pack proppant and reservoir produced sand which could otherwise enter pipe string 30.

In the embodiment illustrated, however, an alternate path system 52 having shunt tubes 54 is utilized to facilitate formation of a desirable gravel pack around the sand control system 36. The shunt tubes 54 provide an alternate path to transport gravel slurry for gravel packing operations. This alternate path allows the gravel packing operation to continue in the event of the presence or formation of a mechanical obstruction along the primary annular flow path of the gravel slurry.

Some of the packers 40 are in the form of isolation packers 56 which may be constructed to allow linear passage of the shunt tubes 54. The isolation packers 56 provide annular mechanical and pressure isolation, i.e. reservoir segmentation. These isolation packers 56 also may facilitate gravel packing via the shunt tubes 54 while assisting in hydrocarbon management during production of hydrocarbons from the various segments/zones. In this embodiment, the isolation packers 56 are hydraulic mechanical packers which are hydraulically actuated via pressure applied down through pipe string 30.

In various embodiments, the pipe string 30 also may comprise a space out blank 58 which works in cooperation with the top or uphole packer 40 which may be in the form of a top gravel pack packer 60. The space out blank 58 effectively spaces out the top gravel pack packer 60 to an approved setting depth and further builds distance between a main gravel pack port 64 and the top of the sand control system 36, e.g. the top of the first sand screen 38, for reserve gravel slurry. The top gravel pack packer 60 serves to hold the sand control system 36 in place for the life of the well. Additionally, the top gravel pack packer 60 provides an annular pressure barrier for performing gravel pack operations involving the pipe string 30 and a surrounding annulus 66. In this embodiment, the top gravel pack packer 60 may be a hydraulically actuated packer.

As illustrated, the pipe string 30 further comprises a quick connect sub 68. The quick connect sub 68 is constructed and positioned to simplify make up between the assembly containing top gravel pack packer 60 and the sand control system 36. The quick connect sub 68 enables the make up between components to occur via vertical landing or mating of interlocking components with minimum to no rotation of those components or attached assemblies.

Additionally, a gravel pack extension 70 may be constructed with a suitable closure sleeve for selectively closing the main gravel pack port 64. The gravel pack extension 70 further houses a primary gravel pack tool 72 while providing a mechanical barrier against sand production post gravel packing operations. The primary gravel pack tool 72 may be in the form of an open hole anti-swab gravel pack service tool which connects the assembly containing top gravel pack packer 60 with a service string portion 74 located within the sand control system 36. The primary gravel pack tool 72 acts as a conduit to, for example, communicate pressure for setting multiple hydraulically actuated packers 40 and to provide multiple flow paths of circulation for gravel slurry and for fluid used in pre- and post gravel pack treatments.

Other features and components of pipe string 30 may include diverter valves 76 which are positioned along the service string portion 74 to divert fluid returns and to thus prevent unwanted pressure buildup. Additional features may include gauges 78, e.g. memory gauges contained within gauge carriers. The gauges 78 may be used to record pressures, such as external pressures, inner wash pipe pressures, or both pressures during installation of sand control system 36 and during gravel packing operations. The data collected can be useful for various analyses, including post job analysis. Similarly, an additional gauge carrier 80 may be positioned above the top gravel pack packer 60 and may contain gauges 82, e.g. memory gauges, for recording external pressures, internal pressures, or both.

Furthermore, a plurality of hydraulic setting ports 84 may be positioned along service string portion 74. The hydraulic setting ports 84 are located so as to enable hydraulic setting of, for example, hydraulic mechanical packers 56 when pressure is built up along the interior of pipe string 30, e.g. along the interior of service string portion 74. Remote control over the ability to build up the desired setting pressure may be achieved by valve actuator tool 46 which may be selectively controlled to block flow down through service string portion 74/pipe string 30 or to allow flow. When flow is blocked, desired actuating pressures may be built up within service string portion 74 so as to actuate hydraulic mechanical packers 56 via hydraulic setting ports 84 and/or to actuate other hydraulic devices. In this example, the valve actuator tool 46 is in the form of a pressure pulse activated device 86.

Figure 2:
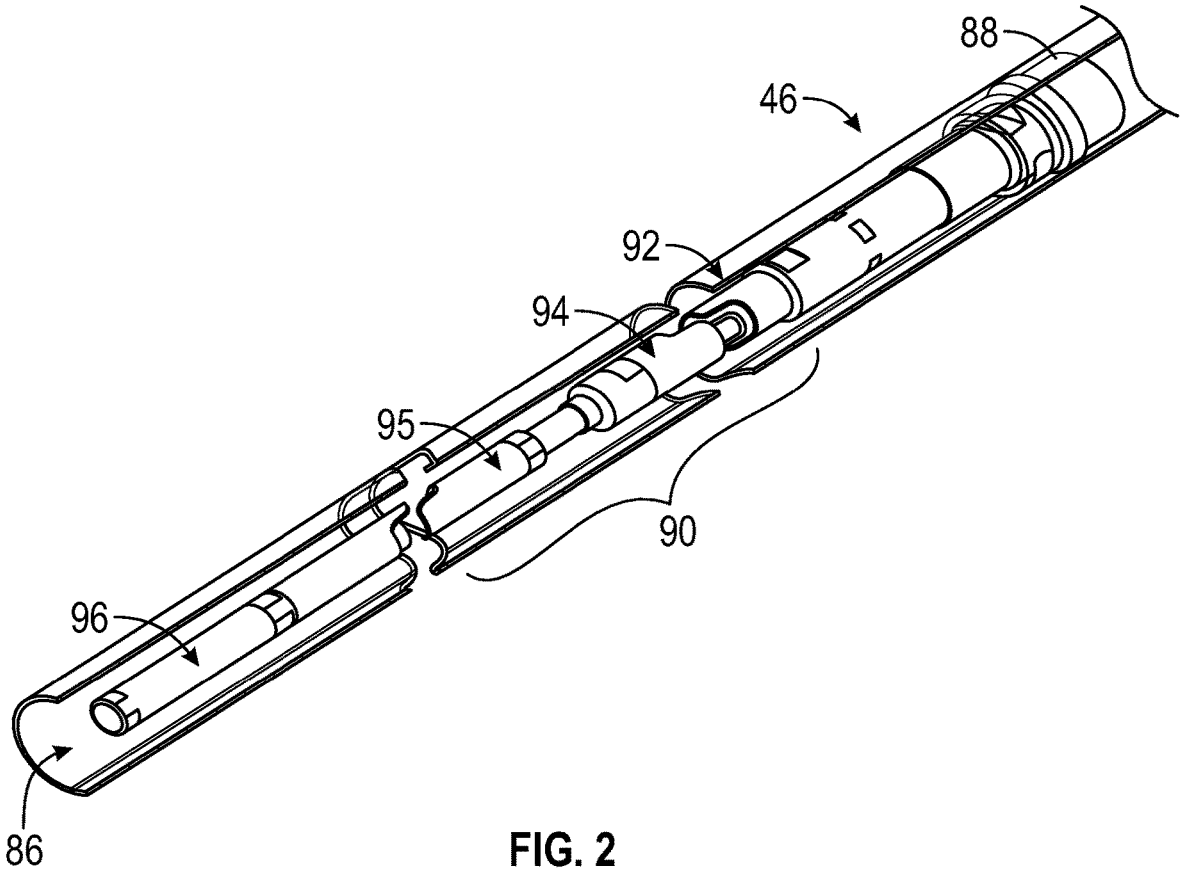
FIG. 2 is an illustration of an example of a portion of the well equipment illustrated in FIG. 1 and showing a pressure pulse activated device which may be used to enable control over flow through a pipe string, according to an embodiment of the disclosure.

With reference to FIG. 2, an embodiment of the pressure pulse activated device 86 is further illustrated. The pressure pulse activated device 86 may comprise a connection end 88 having threads or other connection features which allow the pressure pulse activated device 86 to be coupled to service string portion 74 or to other appropriate components of pipe string 30. Additionally, the pressure pulse activated device 86 comprises an operating system 90 having various features which enable the selective opening and closing of flow along the interior of pipe string 30 so as to enable buildup of hydraulic actuation pressure.

By way of example, the operating system 90 may comprise a valve system 92 having one or more valves which may be selectively operated. The valve system 92 may be in the form of a multi-cycle mechanism that enables selective opening and closing of valves to allow fluid circulation and returns while also enabling selective buildup of pressure to set hydraulically actuated devices, e.g. isolation packers 56 for zonal isolation.

Additionally, the operating system 90 comprises an actuator 94 coupled to the valve system 92 to enable selective valve actuation to desired circulation or pressure build positions. The valve actuator 94 may be equipped with an equalization mechanism to enable equalization of pressures. In some embodiments, the valve actuator 94 may be electrically actuated and may be powered by a suitable battery pack 95 designed to supply electric power for driving the electronics and motor of the valve actuator 94 when actuating the valve system 92 between valve open and valve closed positions.

In this example, the operating system 90 is controlled remotely via mud pulses which are pressure pulses delivered downhole. A mud pulse modem 96 receives the pressure pulses and interprets the signature of the pressure pulses so as to cause the valve actuator 94 to shift the valve system 92 to the desired open/close position. The mud pulse modem 96 contains suitable electronics, e.g. memory gauge, microprocessor, and firmware. The function of the mud pulse modem 96 may be driven by the microprocessor and firmware to interpret the pressure pulses independent of other activities occurring downhole. Effectively, the mud pulse modem 96 enables the use of low-pressure commands established by, for example, circulation and pressure amplitude while enabling flexibility as to the specific signatures of the low-pressure commands according to the parameters of a given downhole job. The mud pulse modem 96 also is insensitive to temperature variation resulting during, for example, the pumping of different circulating fluids.

Figure 3:
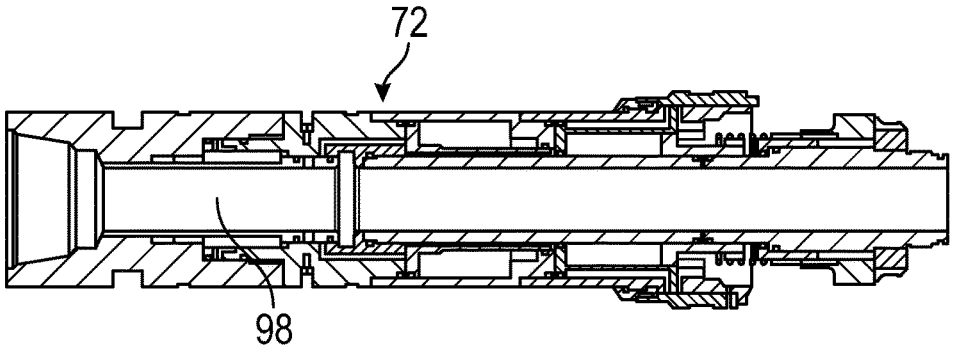
FIG. 3 is an illustration of an example of a portion of the well equipment illustrated in FIG. 1 and showing a gravel pack service tool which controls certain actions within the pipe string, according to an embodiment of the disclosure.

The pressure pulse activated device 86 enables the deployment of sand control system 36 and open hole gravel packing system 34, e.g. top gravel pack packer 60, service string portion 74, and other components of the gravel packing system 34, in a single trip downhole while preserving the ability to hydraulically actuate various devices, e.g. isolation packers 56. The ability to build up pressure also enables hydraulic actuation of a variety of other devices. As illustrated in FIG. 3, for example, the primary gravel pack tool 72 may be hydraulically actuated via a hydraulically actuated isolating piston 98. By closing off flow via pressure pulse activated device 86, a suitable pressure may be built up to shift isolating piston 98 to the desired actuation position, e.g. a position opening or closing gravel pack port 64, setting packer 60, and/or releasing service string portion 74

Figure 4:
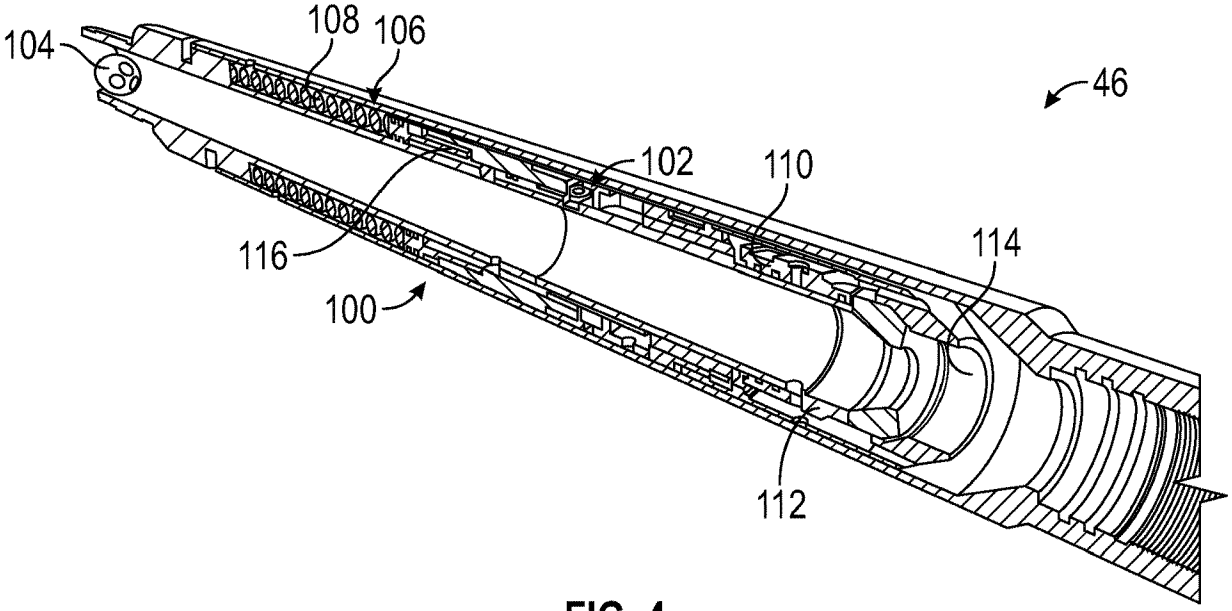
FIG. 4 is an illustration of another example of a portion of the well equipment illustrated in FIG. 1 and showing an alternate embodiment of a device which may be used to enable control over flow through the pipe string, according to an embodiment of the disclosure.

According to another embodiment, the valve actuator tool 46 is in the form of a drop ball activated mechanism 100 which is further illustrated in FIG. 4. The drop ball activated mechanism 100 enables use of a ball to provide a buildup in pressure for actuating hydraulically actuated devices and subsequent release of the ball to enable flow through. In the illustrated example, the drop ball activated mechanism 100 comprises an indexer mechanism 102 which may be selectively indexed to hold or release a ball 104. The indexer mechanism 102 may be in the form of an index head spiral mechanism able to rotate gearing toward different key slots during pressure cycles.

The drop ball activated mechanism 100 also may comprise a spring mechanism actuator tool 106. The spring mechanism actuator tool 106 may utilize a spring 108 or other suitable mechanism which provides additional forces to facilitate indexing motion, e.g. downward indexing motion, of indexer mechanism 102. According to an embodiment, the drop ball activated mechanism 100 also may comprise a rupture device 110, e.g. a rupture pin. The rupture device 110 may be provided as a mechanical override when a predetermined pressure is applied.

During a hydraulic actuation procedure, ball 104 is caught in an expandable ball seat 112 to enable creation of the desired pressure differential across the ball seat 112 so as to allow actuation of, for example, isolation packers 56. When the indexer mechanism 102 is cycled to the appropriate position, pressure may be applied to the ball 104 so as to force the ball seat 112 to expand and to release the ball 104. As a result, the ball 104 may be discharged downhole leaving zero debris and enabling flow therethrough. The ball 104, indexer mechanism 102, and ball seat 112 cooperate to serve as a valve for selectively controlling flow. In some embodiments, a rotational ball seat 114 may be employed to enable the expelling of ball 104 so as to create a flow path for fluid returns. Additionally, a piston 116 may be employed to also facilitate the indexing motion, e.g. upward indexing motion, of indexer mechanism 102. Accordingly, alternating pressure cycles may be used in cooperation with spring 108 to cycle the indexer mechanism 102, and thus the ball seats, to different operational positions.

Figure 5:
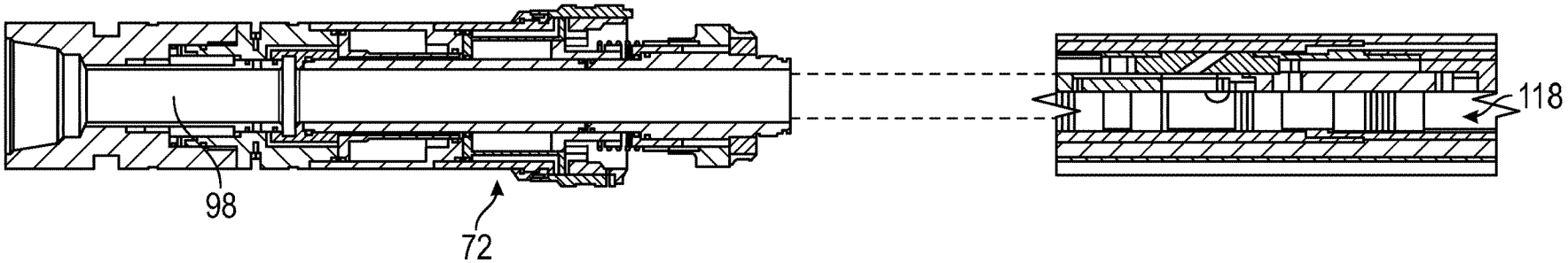
FIG. 5 is an illustration of another example of a portion of the well equipment illustrated in FIG. 1 and showing another embodiment of the gravel pack service tool, according to an embodiment of the disclosure.

This type of hydraulic actuation system may be used with a variety of the primary gravel pack tools 72, an example of which is illustrated in FIG. 5. Once again, the primary gravel pack tool 72 may be hydraulically actuated via hydraulically actuated isolating piston 98. In some embodiments, the tool 72 may utilize a sleeve with rupture devices 118 to provide pressure insensitivity during running-in-hole, fluid circulation, and fluid returns. In some embodiments, the tool 72 may be constructed with a combination of an isolated piston and rupture disc valve which allow a certain level of fluid circulation, e.g. up to 10 barrels per minute, as well as return rates without inadvertently setting or releasing hydraulically actuated devices.

According to an operational example, the drop ball activated mechanism 100 may be used to hydraulically actuate various devices when the sand control system 36 and gravel packing system 34 are deployed in a single trip. The drop ball activated mechanism 100 may be placed at a suitable location along, for example, service string portion 74 of gravel pack system 34. The mechanism 100 is constructed to control and enable desired fluid flows, such as fluid circulation during washdown and returns through a fully open internal diameter once the ball 104 is released.

In this operational example, once the ball 104 has landed in the appropriate ball seat 112, 114, pressure may be applied from the surface to set the top gravel pack packer 60. When this pressure is released, the indexer mechanism 102 cycles to a subsequent position. At this stage, suitable packer test may be employed via, for example, pulling and pushing on pipe string 30. Upon confirmation of packer 60 being set, pressure may again be increased to set the isolation packers 56 and to release the service tool/service string portion 74. The pressure may then be released to cycle the indexer mechanism 102. After appropriate cycling of indexer mechanism 102, the ball 104 is released and full flow along the interior of pipe string 30 is enabled. In some embodiments, the cycling of indexer mechanism 102 may involve increasing the pressure to a sufficient level so as to rupture a rupture device, e.g. a rupture disc, which protects the system against inadvertent actuation.

Depending on reservoir properties, production objectives, type of equipment employed, and/or other parameters of a given job, the number and type of components selected may vary. For example, the number of hydraulically actuated isolation packers 56 may vary according to the number of desired production well zones. Additionally, various types of sensor systems and other job monitoring devices may be employed. The specific stages or sequences of a given gravel packing operation and of the subsequent production operation also may be adjusted. In some embodiments, the equipment includes a large internal diameter to accommodate installation of intelligent completion equipment used in optimizing oil and gas recovery.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is intended that the scope of the disclosure herein should not be limited by the particular embodiments described above.

What is claimed is:

1. A system for use in a well, comprising:

a pipe string for open hole gravel packing, the pipe string including:

an isolation packer;

a gravel packer; and at least one filtration medium; and a pressure pulse activated device connected along the pipe string, the pressure pulse activated device including:

a valve;

a valve actuation device that is capable of being remotely activated via pressure pulses; and an indexer mechanism movable between a first position and a second position, wherein in response to a first pressure pulse, the valve actuation device is configured to move the indexer mechanism to the first position to set the gravel packer and, in response to a second pressure pulse, the valve actuation device is configured to move the indexer mechanism to the second position to set the isolation packer.

2. The system as recited in claim 1, wherein the at least one filtration medium comprises a plurality of sand screens of a sand control assembly.

3. The system as recited in claim 2, wherein the gravel packer configured to hold the plurality of sand screens in place in the borehole during a life of the well.

4. The system as recited in claim 1, wherein the pipe string further comprises a plurality of isolation packers configured to provide annular and pressure isolation along a borehole.

5. The system as recited in claim 4, wherein the plurality of isolation packers comprises hydraulic mechanical packers.

6. The system as recited in claim 1, wherein the pipe string further comprises a plurality of gauges configured to monitor pressures along the pipe string.

7. A system for use in a well, comprising:

a pipe string for open hole gravel packing, the pipe string being equipped with at least one filtration medium;

a first packer;

a second packer;

a valve connected along the pipe string, the valve comprising a releasable ball seat; and a ball seat setting mechanism that is capable of remotely activating the valve via hydraulic pressures, the ball seat setting mechanism including an indexer mechanism movable between a first position and a second position, wherein in response to a first pressure pulse, the indexer mechanism moves to the first position to set the first packer and, in response to a second pressure pulse, the indexer mechanism moves to the second position to set the second packer.

8. The system as recited in claim 7, wherein the at least one filtration medium comprises a plurality of sand screens of a sand control assembly.

9. The system as recited in claim 8, wherein the second packer is an isolation packer and the pipe string further comprises a plurality of isolation packers configured to provide annular and pressure isolation along the borehole.

10. The system as recited in claim 9, wherein the plurality of isolation packers comprises hydraulic mechanical packers.

11. The system as recited in claim 8, wherein the first packer is a gravel packer configured to hold the plurality of sand screens in place in the borehole during the life of the well.

12. The system as recited in claim 8, wherein the pipe string further comprises a plurality of gauges configured to monitor pressures along the pipe string.

13. A method for use in a well, comprising:

providing a pipe string including:

an open hole gravel pack system having a gravel packer;

a sand screen assembly having a plurality of sand screens;

a hydraulic pressure actuated open hole packer; and a pressure pulse activated device including:

a valve;

a valve actuation device that is capable of being remotely activated via pressure pulses; and an indexer mechanism movable between a first position and a second position;

running the pipe string downhole in a single trip;

applying a first pressure pulse to the valve actuation device to move the indexer mechanism to the first position and actuate the gravel packer;

applying a second pressure pulse to the valve actuation device to move the indexer mechanism to the second position and actuate the hydraulic pressure actuated open hole packer to enable a gravel packing operation; and finishing the gravel packing operation around the plurality of sand screens.

14. The method as recited in claim 13, further comprising employing an alternate path system to facilitate the gravel packing operation.

15. The method as recited in claim 13, wherein applying the first pressure pulse and applying the second pressure pulse comprise applying the first pressure pulse and the second pressure pulse to a ball disposed in a ball seat.

* * * * *